US011692784B2

(12) United States Patent
Zimmer

(10) Patent No.: US 11,692,784 B2
(45) Date of Patent: Jul. 4, 2023

(54) ACCESSORY MOUNT FOR MACHINE GUN SPADE GRIP

(71) Applicant: Trent Zimmer, Broussard, LA (US)

(72) Inventor: Trent Zimmer, Broussard, LA (US)

( * ) Notice: Subject to any disclaimer, the term of this patent is extended or adjusted under 35 U.S.C. 154(b) by 0 days.

(21) Appl. No.: 17/712,469

(22) Filed: Apr. 4, 2022

(65) Prior Publication Data

US 2022/0228831 A1 Jul. 21, 2022

Related U.S. Application Data

(63) Continuation-in-part of application No. 17/468,626, filed on Sep. 7, 2021.

(60) Provisional application No. 63/074,505, filed on Sep. 4, 2020.

(51) Int. Cl.

| | |
|---|---|
| ***F41A 19/07*** | (2006.01) |
| ***F41A 35/00*** | (2006.01) |
| ***F41A 19/10*** | (2006.01) |

(52) U.S. Cl.

CPC ..... *F41A 19/07* (2013.01); *F41A 19/10* (2013.01); *F41A 35/00* (2013.01)

(58) Field of Classification Search

CPC ..... F41C 27/00; F41A 35/00; F41G 11/003; F41G 11/004; F16B 2200/30

See application file for complete search history.

(56) References Cited

U.S. PATENT DOCUMENTS

| | | | | |
|---|---|---|---|---|
| 4,383,371 | A * | 5/1983 | Coffey | F41G 11/003 42/126 |
| 5,621,999 | A * | 4/1997 | Moore | F41G 1/35 42/117 |
| 5,694,712 | A * | 12/1997 | Plonka | F41G 11/003 42/124 |
| 7,134,234 | B1 * | 11/2006 | Makarounis | F41G 11/004 42/114 |
| 7,882,654 | B1 * | 2/2011 | Marcum | F41G 1/02 42/146 |
| 8,925,236 | B1 * | 1/2015 | Mayberry | F41G 11/004 42/124 |
| D795,380 | S * | 8/2017 | Gibbens | F41C 23/16 D22/108 |
| 10,240,901 | B1 * | 3/2019 | Cheng | F41A 35/00 |
| 11,035,645 | B1 * | 6/2021 | Robinson | F41C 27/00 |
| 11,536,535 | B2 * | 12/2022 | Mayberry | F41G 11/001 |

(Continued)

*Primary Examiner* — Joshua E Freeman

(74) *Attorney, Agent, or Firm* — Asgaard Patent Services, LLC; F. Wayne Thompson, Jr.

(57) ABSTRACT

Disclosed are implementations of an accessory mount for a machine gun spade grip. An example accessory mount is configured for attachment to a firearm spade grip and comprises: a bridge member having a top and a bottom, the top of the bridge member includes a mounting interface and the bottom of the bridge member includes a cutout adapted to receive a portion of the firearm spade grip therein; a clamp member removably attached to the bottom of the bridge member; an actuator arm having a base and a distal end, the base of the actuator arm is attached to the top of the bridge member; and a paddle actuator rotatably connected to the distal end of the actuator arm. Some implementations of the accessory mount include a cross-bolt safety axially displaceable between an active position, whereby rotational movement of the paddle actuator is prevented, and an inactive position.

19 Claims, 16 Drawing Sheets

(56) References Cited

U.S. PATENT DOCUMENTS

| | | | | |
|---|---|---|---|---|
| 2001/0027620 | A1* | 10/2001 | Wooten | F41G 11/003 248/229.1 |
| 2002/0109057 | A1* | 8/2002 | Wooten | F41G 1/35 248/229.1 |
| 2004/0103577 | A1* | 6/2004 | Compton | F41C 27/00 42/86 |
| 2005/0011104 | A1* | 1/2005 | Oz | F41G 11/003 42/124 |
| 2007/0044365 | A1* | 3/2007 | Deken | F41C 27/00 42/146 |
| 2011/0100203 | A1* | 5/2011 | Genes | F41G 11/003 89/36.06 |
| 2012/0081913 | A1* | 4/2012 | Dew | F21V 21/0885 362/396 |
| 2012/0159831 | A1* | 6/2012 | LaFrance | F41G 1/387 42/90 |
| 2019/0093985 | A1* | 3/2019 | Robinson | H04N 5/2253 |
| 2021/0239429 | A1* | 8/2021 | Moore | F41G 3/30 |
| 2021/0262768 | A1* | 8/2021 | Gerlings | F41C 23/02 |
| 2021/0325144 | A1* | 10/2021 | Kincel | F41C 23/16 |

* cited by examiner

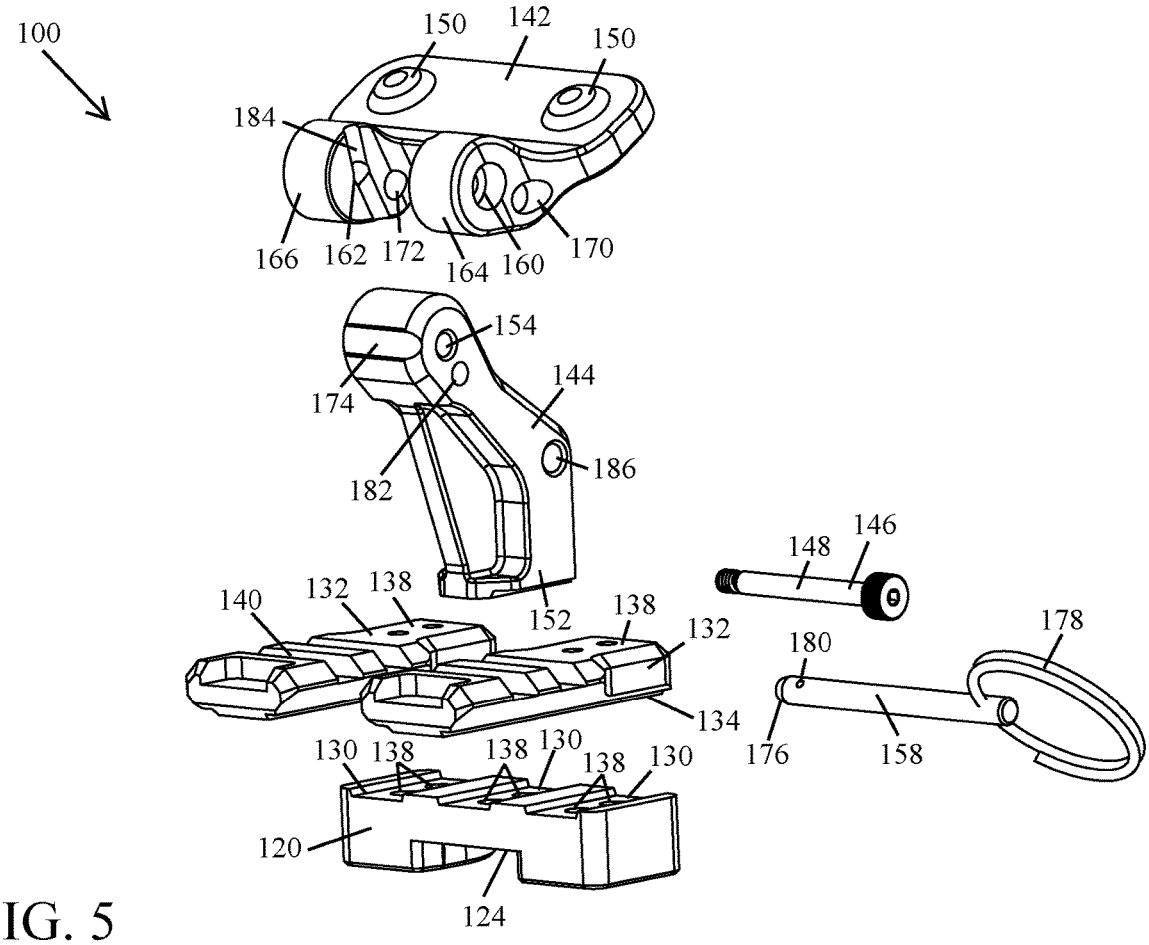
FIG. 5
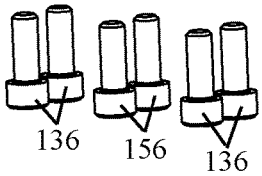
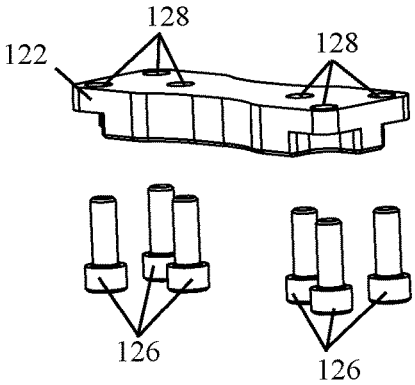

ACCESSORY MOUNT FOR MACHINE GUN SPADE GRIP

CROSS-REFERENCE TO RELATED APPLICATIONS

This is a continuation-in-part application claiming the benefit of U.S. patent application Ser. No. 17/468,626, filed on Sep. 7, 2021, which claims the benefit of U.S. Provisional Application Ser. No. 63/074,505, filed on Sep. 4, 2020, the entireties of both applications are incorporated herein by reference.

TECHNICAL FIELD

This disclosure relates to implementations of an accessory mount that can be attached to the spade grip of a machine gun.

BACKGROUND

Machine guns mounted to vehicles and tripods are usually equipped with spade grips, instead of buttstocks. A typical spade grip includes twin handles disposed on opposite sides of, and adjacent to, a thumb pad trigger mechanism so that a user's thumb(s) will naturally rest against the thumb pad trigger mechanism when grasping one or both handles.

Modern firearms, including machine guns, are routinely equipped with flashlights, infrared and visible laser sights, and other electrically powered accessories. These weapon-mounted electrical accessories are often used in conjunction with remote switches, also referred to as control devices, for convenience. However, machine guns equipped with a spade grip lack an ergonomic position to mechanically attach one or more control devices in close proximity to the thumb pad trigger mechanism.

Accordingly, it can be seen that needs exist for the accessory mount for a machine gun spade grip disclosed herein. It is to the provision of an accessory mount for a machine gun spade grip configured to address these needs, and others, that the present invention is primarily directed.

SUMMARY OF THE INVENTION

Implementations of an accessory mount for a machine gun spade grip are provided. In general, a spade grip includes twin handles that are disposed on opposite sides of, and adjacent to, a thumb pad trigger mechanism for a firearm, such as a machine gun. The accessory mount is attached to the upper arm of the spade grip, adjacent one of the twin handles. One or more control devices used to operate weapon-mounted electrical accessories can be attached to the accessory mount.

An example accessory mount for a firearm spade grip comprises:

- a bridge member having a top and a bottom, the top of the bridge member includes a mounting interface and the bottom of the bridge member includes a cutout adapted to receive a portion of the firearm spade grip therein;
- a clamp member removably attached to the bottom of the bridge member;
- an actuator arm having a base and a distal end, the base of the actuator arm is attached to the top of the bridge member; and
- a paddle actuator rotatably connected to the distal end of the actuator arm.

Another example accessory mount for a firearm spade grip comprises:

- a bridge member having a top and a bottom, the top of the bridge member includes three mounting interfaces and the bottom of the bridge member includes a cutout adapted to receive a portion of the firearm spade grip therein;
- a clamp member removably attached to the bottom of the bridge member;
- an actuator arm having a base and a distal end, the base of the actuator arm is attached to one of the three mounting interfaces on the top of the bridge member; and
- a paddle actuator rotatably connected to the distal end of the actuator arm.

Yet another example accessory mount for a firearm spade grip comprises:

- a bridge member having a top and a bottom, the top of the bridge member includes a mounting interface and the bottom of the bridge member includes a cutout adapted to receive a portion of the firearm spade grip therein;
- a clamp member removably attached to the bottom of the bridge member;
- an actuator arm having a base and a distal end, the base of the actuator arm is attached to the top of the bridge member;
- a paddle actuator rotatably connected to the distal end of the actuator arm;
- a control device configured to operate at least one weapon-mounted electrical accessory, the control device is attached to the mounting interface on the top of the bridge member; and
- a cross-bolt safety axially displaceable between an active position, whereby rotational movement of the paddle actuator is prevented, and an inactive position.

BRIEF DESCRIPTION OF THE DRAWINGS

FIG. 5 illustrates an exploded view of the accessory mount shown in FIG. 4.

Like reference numerals refer to corresponding parts throughout the several views of the drawings.

DETAILED DESCRIPTION

Figure 1:
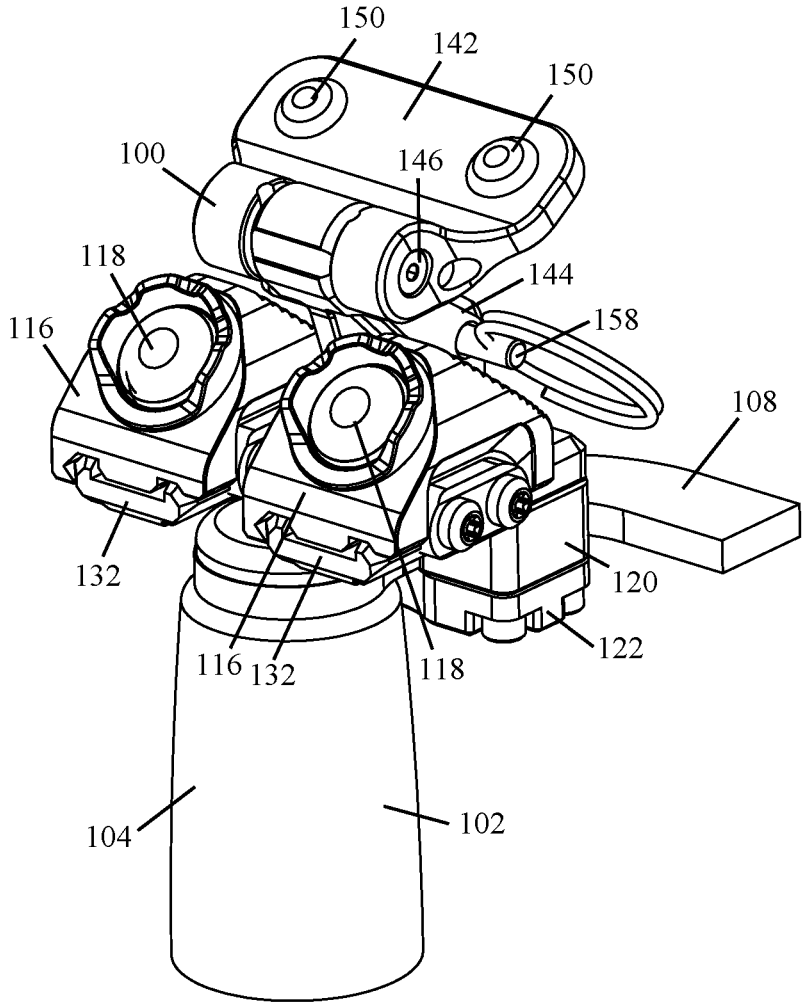
FIG. 1 illustrates an example accessory mount according to the principles of the present disclosure, wherein the accessory mount is secured to the spade grip of a machine gun and the paddle actuator is shown flipped back.
Figure 2:
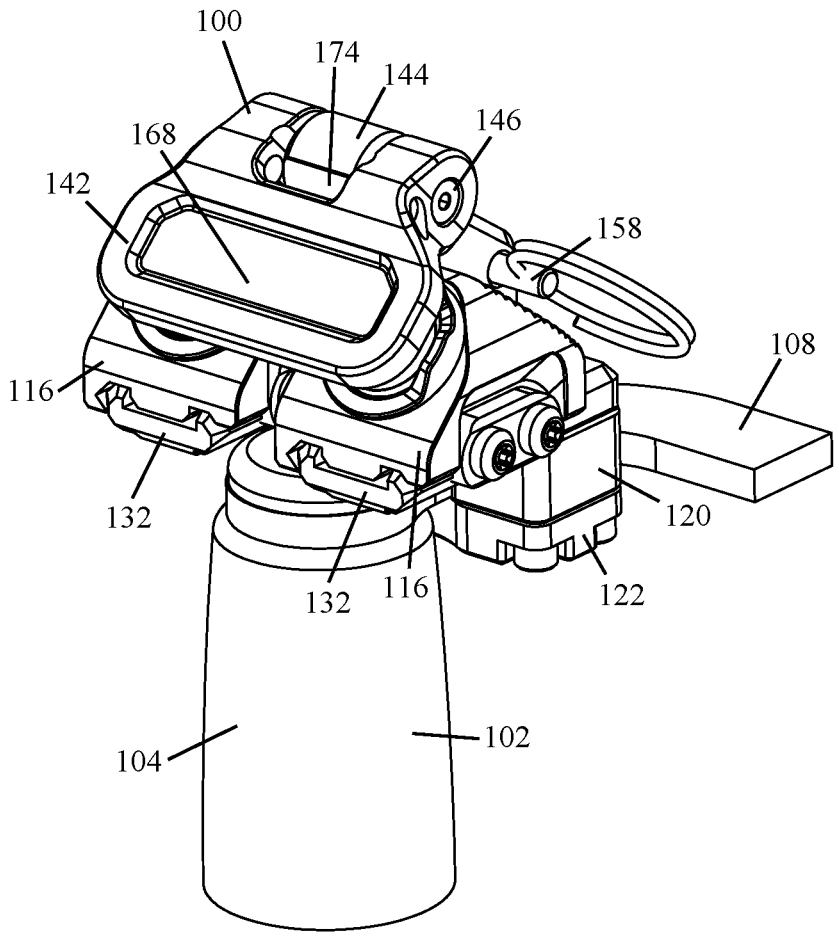
FIG. 2 illustrates the accessory mount shown in FIG. 1, wherein the paddle actuator has been flipped forward.
Figure 3:
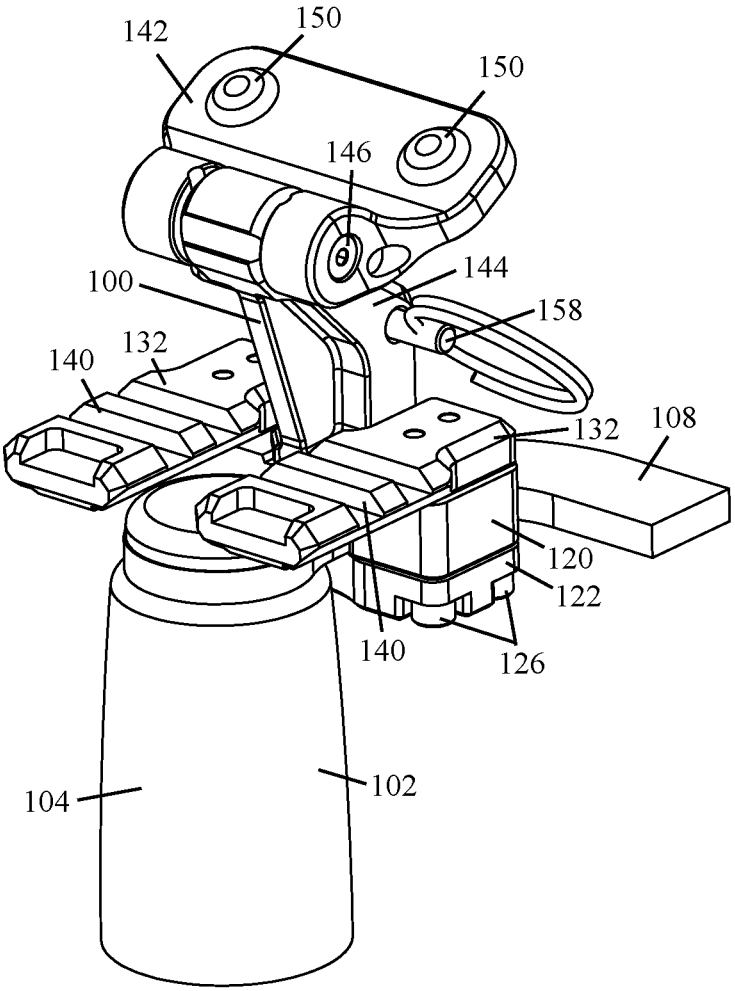
FIG. 3 illustrates the accessory mount shown in FIG. 1, wherein the control devices have been removed.

FIGS. 1-3 illustrate an example accessory mount 100 secured to the spade grip 102 of a machine gun. Though only a partial cutaway of the spade grip 102 is shown in FIGS. 1-3, in general, an example spade grip 102 includes twin handles 104 that are disposed on opposite sides of, and adjacent to, a thumb pad trigger mechanism 106 for a firearm, a machine gun in particular. The accessory mount 100 is attached to the upper arm 108 of the spade grip 102, adjacent a handle 104 thereof. One or more control devices (also referred to as "remote switches") 116, used to operate weapon-mounted electrical accessories, can be attached to the accessory mount 100. An example control device 116 is the Hot Button, sold by Unity Tactical, LLC, shown in the illustrations. Each example control device 116 includes a pushbutton switch 118 and a flexible cable having a connector or plug. The flexible cable is not illustrated for the sake of clarity.

Figure 4:
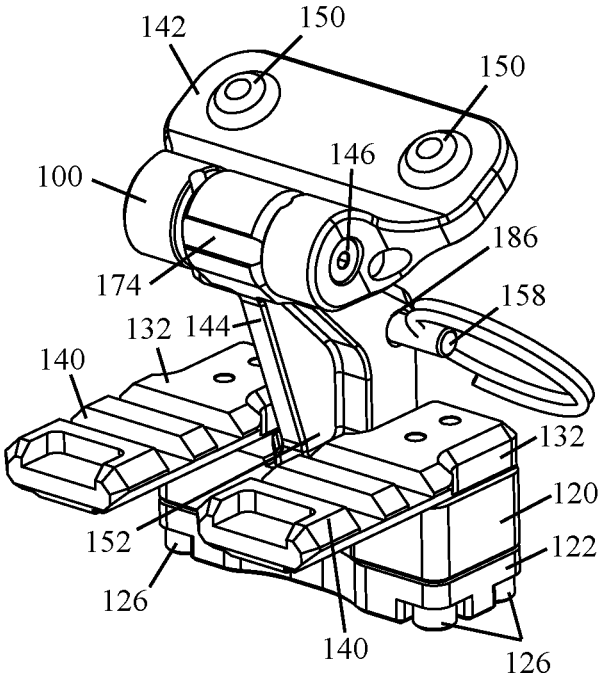
FIG. 4 illustrates the accessory mount shown in FIG. 3 removed from the machine gun spade grip.

As shown best in FIGS. 3-5, an accessory mount 100 includes a bridge member 120 that can be secured to the upper arm 108 of a spade grip 102 by a moveable clamp member 122. The bottom of the bridge 120 includes a cutout 124 adapted to receive a portion of the spade grip arm 108 therein. The clamp member 122 is secured to the bottom of the bridge member 120 by threaded fasteners 126. Each threaded fastener 126 extends through an opening 128 in the clamp member 122 to engage a threaded hole (not shown) in the bottom of the bridge member 120. Tightening the threaded fasteners 126 brings the bridge member 120 and the clamp member 122 together, thereby securing the accessory mount 100 to the upper arm 108 of the spade grip 102 (see, e.g., FIG. 1).

As shown best in FIG. 5, the top of the bridge member 120 includes three mounting interfaces 130. Though, in some implementations, the bridge member 120 may only include one or two mounting interfaces 130. Each mounting interface 130 is a recessed channel in the top of the bridge member 120 configured to receive a portion of an accessory adapter 132, or other compatible component, therein.

Each accessory adapter 132 is configured to be attached to a mounting interface 130 on the top of the bridge member 120. The base 134 of each accessory adapter 132 is configured to fit within the recessed channel of a mounting interface 130. Although, in some implementations, only a portion of the base 134 is configured to fit within the recessed channel of a mounting interface 130. Threaded fasteners 136 are used to attach each accessory adapter 132 to a mounting interface 130 of the accessory mount 100. Each threaded fastener 136 extends through an opening 138 in the bridge member 120 to engage a threaded hole in the proximal end 138 of an accessory adapter 132. The top side of an accessory adapter 132 includes an accessory mounting interface 140 (e.g., a MIL-STD-1913 accessory mounting rail) adapted for the attachment of a control device 116 (see, e.g., FIGS. 1 and 2).

As shown in FIGS. 3-5, in some implementations, the accessory mount 100 may include a paddle actuator 142 that is connected to the bridge member 120 by an actuator arm 144. The actuator arm 144 extends up from the bridge member 120 to position the paddle actuator 142 above the attached control devices 116. The paddle actuator 142 can be used to simultaneously actuate the pushbutton switch 118 of both control devices 116 attached to the accessory mount 100. Also, in conjunction with a lockout pin 158, the paddle actuator 142 can be fixed in position over the pushbutton switches 118 of attached control devices 116. In this way, the paddle actuator 142 is used to prevent actuation of the control devices 116.

As shown in FIG. 5, two axially spaced contact protuberances 150 extend from the bottom face of the paddle actuator 142. In some implementations, as shown in FIG. 5, each contact protuberance 150 is formed in an approximately hemispherical shape. Two knuckles 164, 166 extend from a side of the paddle actuator 142. The first knuckle 164 includes an opening 160 that extends therethrough and the second knuckle 166 includes a threaded hole 162.

The paddle actuator 142 is moveable between a first position (shown in FIG. 1) and a second position (shown in FIG. 2). The paddle actuator 142 rotates about the shaft 148 of a fastener 146 used to secure it to the distal end of the actuator arm 144. The fastener 146 extends through the opening 160 in the first knuckle 164 of the paddle actuator 142, through an opening 154 in the distal end of the actuator arm 144, and engages with the threaded hole 162 in the second knuckle 166 of the paddle actuator 142.

As shown best in FIGS. 4 and 5, the base 152 of the actuator arm 144 is configured to fit within the recessed channel of a mounting interface 130 located on the bridge member 130. In the preferred implementation, the base 152 of the actuator arm 144 is attached to the middle mounting interface 130. Threaded fasteners 156 are used to attach the base 152 of the actuator arm 144 to the mounting interface 130 of the bridge member 120. Each threaded fastener 156 extends through an opening 138 in the bridge member 120 to engage a threaded hole in the base 152 of the actuator arm 144.

In some implementations, spring-loaded detent assemblies are employed to positively position (or removably latch) the paddle actuator 142 in the first position (shown in FIG. 1) and the second position (shown in FIG. 2). Each spring-loaded detent assembly (not shown) is nested in a bore 182 found in each side of the actuator arm 144, near its distal end. Only one bore 182 is shown in the illustrations. Each spring-loaded detent assembly operates in conjunction with a detent locking groove 184 located on the interior side of each knuckle 164, 166 of the paddle actuator 142. The outer end of each spring-loaded detent assembly includes a detent ball that extends slightly out of its bore 182. This configuration, then, allows the detent ball to engage with the detent locking groove 184 when the paddle actuator 142 is rotated into the first position or the second position.

As shown best in FIG. 5, the accessory mount 100 may include a lockout pin 158, the purpose of which will be described below. The lockout pin 158 includes a cylindrical shaft having a chamfered tip 176, and a pull ring 178 attached to one end. The lockout pin 158 also includes a spring-loaded detent assembly 180 positioned near the chamfered tip 176.

As shown in FIG. 1, when the paddle actuator 142 is flipped back, the paddle actuator 142 does not cover, or otherwise inhibit, use of either control device 116 attached to the accessory mount 100.

As shown in FIG. 2, when the paddle actuator 142 is flipped forward, the paddle actuator 142 is positioned over both control devices 116 attached to the accessory mount 100. Further, each contact protuberance 150 is positioned over the pushbutton switch 118 of an underlying control device 116. Applying downward pressure to the top face 168 of the paddle actuator 142 presses the contact protuberances 150 into their respective pushbutton switches 118, thereby actuating both control devices 116 simultaneously.

Although not shown, the paddle actuator 142 can be fixed in the flipped forward position using the lockout pin 158. To do so, the pin openings 170, 172 extending through the paddle actuator 142 are aligned with a groove 174 in the distal end of the actuator arm 144. The lockout pin 158 is then pushed through this alignment of openings (170, 172, 174), thereby fixing the paddle actuator 142 in position over the control devices 116. In this way, the paddle actuator 142 is used to cover, and prevent the use of, the underlying control devices 116.

As shown in FIGS. 1-4, when the lockout pin 158 is not being used, it can be stored within an opening 186 extending through the middle section of the actuator arm 144. The spring-loaded detent assembly 180 prevents the lockout pin 158 from inadvertently falling out.

Figure 6:
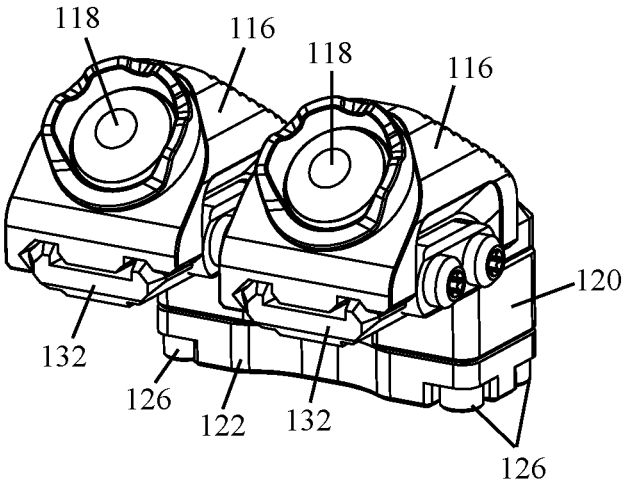
FIGS. 6 and 7 illustrate another configuration of the example accessory mount shown in FIG. 4.
Figure 7:
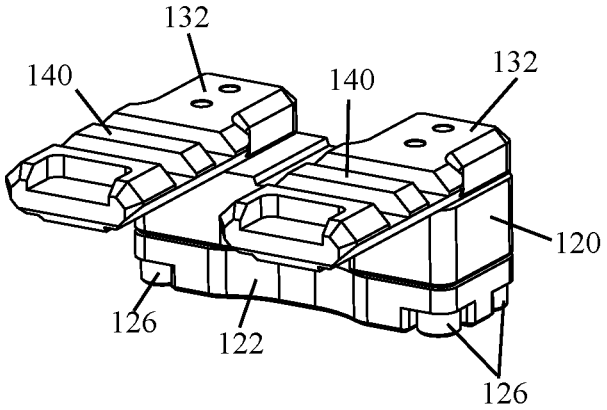

As shown in FIGS. 6 and 7, in some implementations, an accessory mount 100 may be assembled and used without a paddle actuator 142, the actuator arm 144, or a lockout pin 158. Such a configuration of the accessory mount 100 includes the bridge member 120, the moveable clamp member 122, and two accessory adapters 132.

Figure 8:
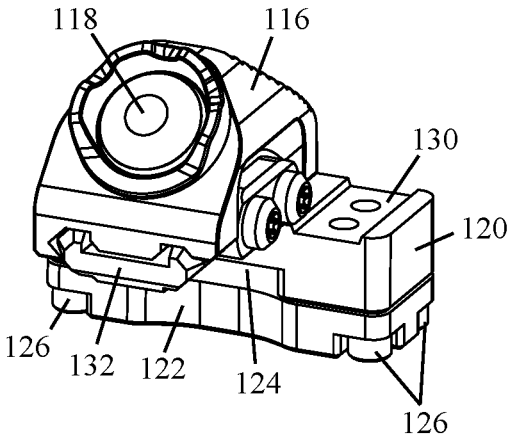
FIGS. 8 and 9 illustrate yet another configuration of the example accessory mount shown in FIG. 4.
Figure 9:
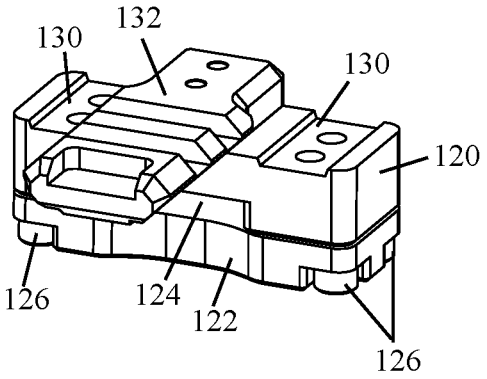

As shown in FIGS. 8 and 9, in some implementations, an accessory mount 100 may be assembled and used with only a single accessory adaptor 132. Such a configuration of the accessory mount 100 includes the bridge member 120, the moveable clamp member 122, and a single accessory adapter 132 attached to the center mounting interface 130 of the bridge member 120.

Figure 10:
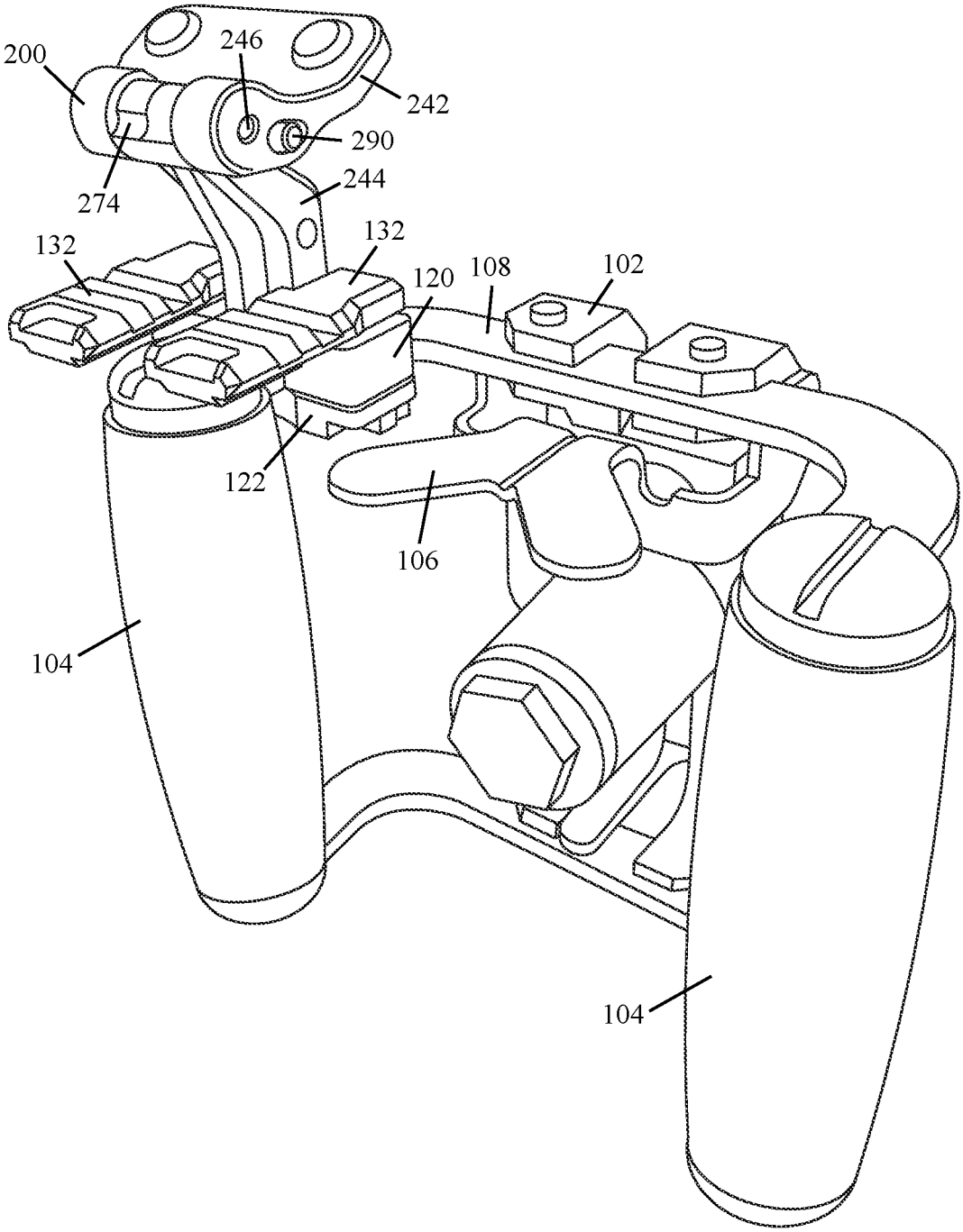
FIG. 10 illustrates another example accessory mount according to the principles of the present disclosure, wherein the accessory mount is secured to the spade grip of a machine gun and the paddle actuator is shown flipped back.
Figure 11:
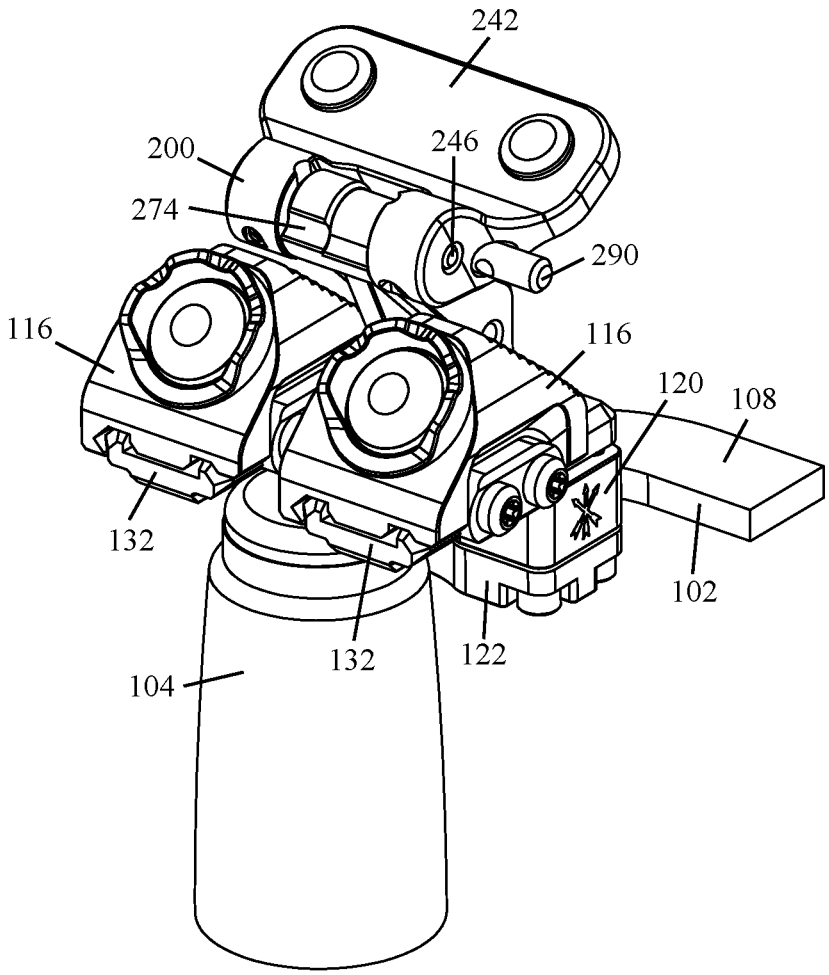
FIG. 11 illustrates the accessory mount shown in FIG. 10, wherein control devices have been attached to the accessory adapters.
Figure 12:
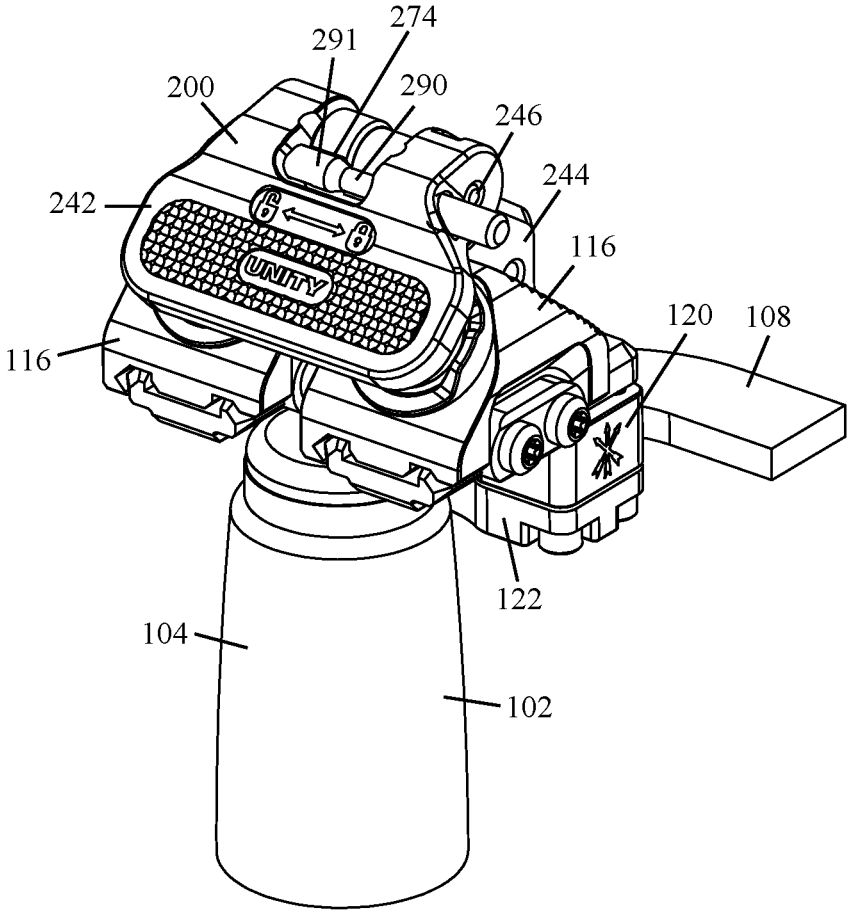
FIG. 12 illustrates the accessory mount shown in FIG. 11, wherein the paddle actuator has been flipped forward.
Figure 13:
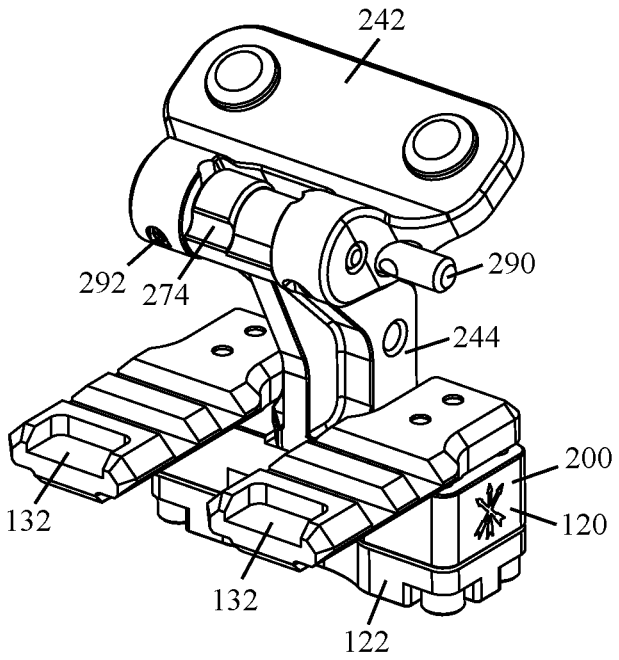
FIG. 13 illustrates the accessory mount shown in FIG. 10 removed from the machine gun spade grip.

FIGS. 10-12 illustrate another example accessory mount 200 secured to the spade grip 102 of a machine gun. The spade grip 102 includes twin handles 104 that are disposed on opposite sides of, and adjacent to, a thumb pad trigger mechanism 106 for a firearm, a machine gun in particular. The accessory mount 200 is similar to the accessory mount 100 discussed above, but the paddle actuator 242 and the actuator arm 244 have been modified to incorporate a cross-bolt safety 290 that replaces the lockout pin 158.

The paddle actuator 242 rotates about the shank 248 of a pivot pin 246 coupling it to the distal end of the actuator arm 244. The pivot pin 246 is positioned within a bore defined by openings 260, 262 in the knuckles 264, 266 of the paddle actuator 242, and an opening 254 in the distal end of the actuator arm 244. The openings (254, 260, 262) defining the bore are axially aligned. A retaining pin 292, positioned within another opening 267 in one knuckle 266 of the paddle actuator 242, holds the pivot pin 246 in position. The retaining pin 292 includes a threaded head 292*a* and an elongate shaft 292*b*. The threaded head 292*a* is used to secure the retaining pin 292 within the opening 267 in the paddle actuator 242. The elongate shaft 292*b* of the retaining pin 292 extends across a circumferential groove 249 in the shank 248 of the pivot pin 246. In this way, lateral displacement of the pivot pin 246 is prevented. The elongate shaft 292*b* in the illustrated embodiment is cylindrical and has a circular cross-section, although other non-circular cross-sectional shapes are possible (e.g., square).

Figure 14:
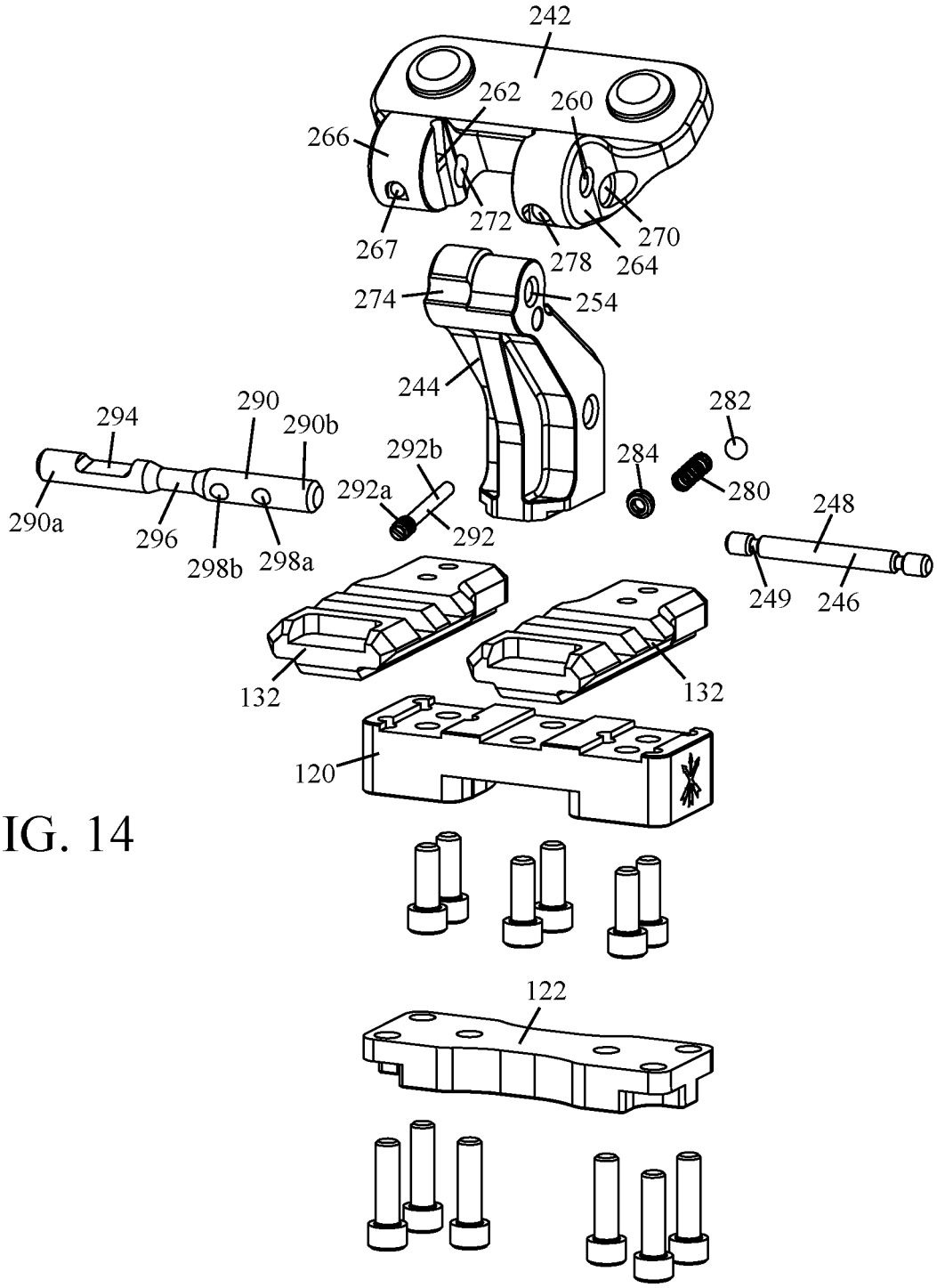
FIG. 14 illustrates an exploded view of the accessory mount shown in FIG. 13.
Figure 15:
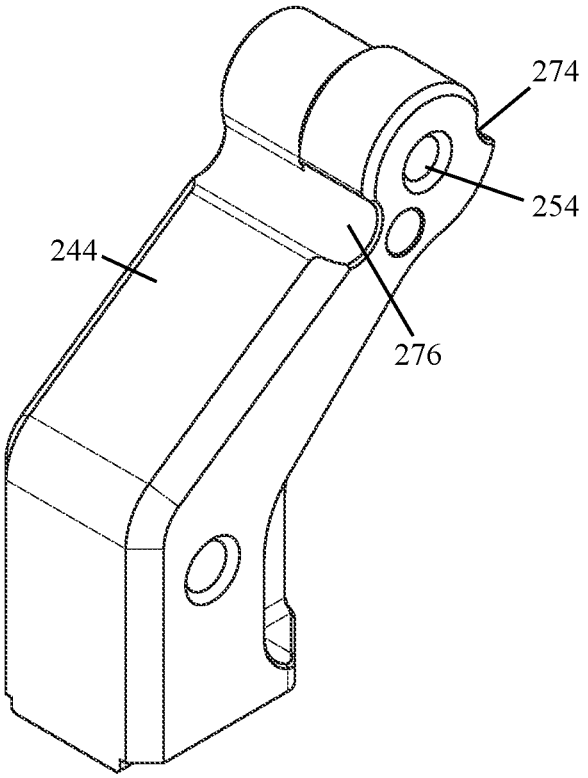
FIGS. 15 and 16 illustrate isometric views of the actuator arm shown in FIG. 14.
Figure 16:
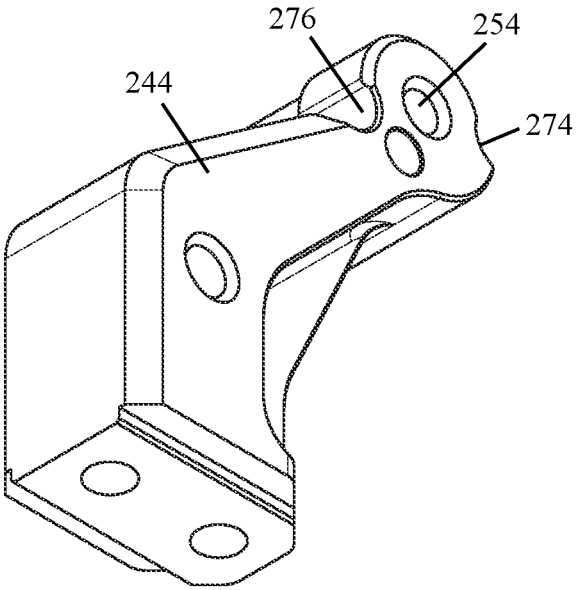

As shown best in FIGS. 14 and 15, the actuator arm 244 includes a groove 274, 276 in a front side and a back side of the distal end. The forward-facing groove 274 is positioned to be in axial alignment with an aperture 270, 272 in each knuckle 264, 266 of the paddle actuator 242 when the paddle actuator 242 is in the flipped forward position; the rearward facing groove 276 is positioned to be in axial alignment with the aperture 270, 272 in each knuckle 264, 266 of the paddle actuator 242 when the paddle actuator 242 is in the flipped back position. Each groove 274, 276 defines a curved surface configured to receive therein, at least a portion of, the first end portion 290*a* of the cross-bolt safety 290.

As shown best in FIG. 14, the cross-bolt safety 290 is an elongate rod having two end portions 290*a*, 290*b* separated by a circumferential groove 296. One end portion 290*a* includes a clearance cutout 294 and the other end portion 290*b* includes two detent recesses 298*a*, 298*b*. The cross-bolt safety 290 is axially displaceable between an active position, whereby rotational movement of the paddle actuator 242 is prevented, and an inactive position. In this way, the cross-bolt safety 290 can be used to fix the paddle actuator 242 in either a flipped back position (see, e.g., FIG. 11) or a flipped forward position (see, e.g., FIG. 12). The cross-bolt safety 290 is secured within a bore defined by the aperture 270 in one knuckle 264 that is axially aligned with the aperture 272 in the other knuckle 266 of the paddle actuator 242. The first end portion 290*a* of the cross-bolt safety 290 partially projects from one aperture 272 in the inactive position and the second end portion 290*b* partially projects from the opposing aperture 270 in the active position. In either the inactive or active positions, the cross-bolt safety 290 is readily displaced by pressure from a user's finger on a projecting end portion 290*a*, 290*b*. The retaining pin 292 described above is used to limit lateral movement of the cross-bolt safety 290. In the illustrated embodiment, the elongate shaft 292*b* of the retaining pin 292 extends across the clearance cutout 294 in the first end portion 290*a* of the cross-bolt safety 290. The width of the clearance cutout 294 is greater than the diameter of the retaining pin shaft 292*b*. In this way, the cross-bolt safety 290 is able to laterally move between the inactive position and active position. The detent recesses 298*a*, 298*b* of the cross-bolt safety 290 are axially spaced.

A spring-loaded detent assembly is employed to positively position the cross-bolt safety 290 in both the inactive and active positions, acting as a force-to-overcome mechanism. The spring-loaded detent assembly also provides tactile resistance to any axial displacement of the cross-bolt safety 290. The spring-loaded detent assembly is carried in a bore 278 in one knuckle 264 of the paddle actuator 242. The spring-loaded detent assembly comprises a spring 280, a ball detent 282, and a set screw 284 that retains the spring 280 and ball detent 282 within the bore 278 of the paddle actuator 242. The ball detent 282 is resiliently biased, by the spring 280, for projection into one detent recess 298*a* when the cross-bolt safety 290 is in the inactive position and for projection into the other detent recess 298*b* when the cross-bolt safety 290 is in the active position.

Operation and Use of the Cross-Bolt Safety

The cross-bolt safety 290 can be used to lock the paddle actuator in either the flipped forward position (see, e.g., FIG. 12) or the flipped back position (see, e.g., FIG. 11). Axially displacing (i.e., laterally sliding) the cross-bolt safety 290 to the active position when the paddle actuator 242 is in the flipped forward position or the flipped back position places the first end portion 290*a* of the cross-bolt safety 290 in the forward-facing groove 274 or the rearward facing groove 276, respectively. In this way, the paddle actuator 242 is prevented from rotating, thereby locking it in position.

The paddle actuator 242 can be unlocked by axially displacing (i.e., laterally sliding) the cross-bolt safety 290 to the inactive position. This removes the first end portion 290*a* from the groove (274 or 276) in the front side or back side of the actuator arm 244 and positions the circumferential groove 296 of the cross-bolt safety 290 over the same groove (274 or 276). The circumferential groove 296 of the cross-bolt safety 290 is sized so that it's too small to engage with the curved surface of either groove 274, 276. In this way, the paddle actuator 242 can be rotated between the flipped forward position and the flipped back position.

While a Hot Button control device 116 is shown throughout the illustrations, it is to be understood that other control devices (i.e., remote switches) capable of being attached to one of the accessory mounts 100, 200 disclosed herein may be used.

The bridge 120, the clamp member 122, the accessory adapters 132, the paddle actuators 142, 242, and the actuator arms 144, 244 are fabricated of an aluminum alloy, but could be fabricated of another suitably durable and light weight material (e.g., a stainless-steel alloy).

Although not shown, it is contemplated that an accessory adapter 132 having an integrated control device 116 could be developed and used in conjunction with either accessory mount 100, 200 disclosed herein.

Reference throughout this specification to "an embodiment" or "implementation" or words of similar import means that a particular described feature, structure, or characteristic is included in at least one embodiment of the present invention. Thus, the phrase "in some implementations" or a phrase of similar import in various places throughout this specification does not necessarily refer to the same embodiment.

Many modifications and other embodiments of the inventions set forth herein will come to mind to one skilled in the art to which these inventions pertain having the benefit of the teachings presented in the foregoing descriptions and the associated drawings.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

While operations are depicted in the drawings in a particular order, this should not be understood as requiring that such operations be performed in the particular order shown or in sequential order, or that all illustrated operations be performed, to achieve desirable results.

The invention claimed is:

1. An accessory mount for a firearm spade grip, the accessory mount comprising:

a bridge member having a top and a bottom, the top of the bridge member includes a mounting interface and the bottom of the bridge member includes a cutout adapted to receive a portion of the firearm spade grip therein;

a clamp member removably attached to the bottom of the bridge member;

an actuator arm having a base and a distal end, the base of the actuator arm is attached to the top of the bridge member; and a paddle actuator rotatably connected to the distal end of the actuator arm.

2. The accessory mount of claim 1, further comprising a control device, the control device is attached to the mounting interface on the top of the bridge member.

3. The accessory mount of claim 2, wherein the actuator arm positions the paddle actuator above the control device, and the paddle actuator is configured to actuate the control device when pressed down.

4. The accessory mount of claim 3, further comprising a contact protuberance extending from a bottom face of the paddle actuator, the contact protuberance is positioned to actuate the control device when the paddle actuator is pressed down.

5. The accessory mount of claim 1, further comprising:

an accessory adapter attached to the mounting interface on the top of the bridge member; and a control device, configured to operate at least one weapon-mounted electrical accessory, attached to the accessory adapter.

6. The accessory mount of claim 5, wherein the actuator arm positions the paddle actuator above the control device, and the paddle actuator is configured to actuate the control device when pressed down.

7. The accessory mount of claim 6, further comprising a contact protuberance extending from a bottom face of the paddle actuator, the contact protuberance is positioned to actuate the control device when the paddle actuator is pressed down.

8. The accessory mount of claim 1, further comprising a cross-bolt safety axially displaceable between an active position, whereby rotational movement of the paddle actuator is prevented, and an inactive position.

9. An accessory mount for a firearm spade grip, the accessory mount comprising:

a bridge member having a top and a bottom, the top of the bridge member includes three mounting interfaces and the bottom of the bridge member includes a cutout adapted to receive a portion of the firearm spade grip therein;

a clamp member removably attached to the bottom of the bridge member;

an actuator arm having a base and a distal end, the base of the actuator arm is attached to one of the three mounting interfaces on the top of the bridge member; and a paddle actuator rotatably connected to the distal end of the actuator arm.

10. The accessory mount of claim 9, further comprising two control devices, each of the two control devices is attached to one of the three mounting interfaces on the top of the bridge member.

11. The accessory mount of claim 10, wherein the actuator arm positions the paddle actuator above the two control devices, and the paddle actuator is configured to actuate the two control devices when pressed down.

12. The accessory mount of claim 11, further comprising two contact protuberances extending from a bottom face of the paddle actuator, the two contacts protuberances are positioned to actuate the two control devices when the paddle actuator is pressed down.

13. The accessory mount of claim 9, further comprising two accessory adapters, each of the two accessory adapters is attached to one of the three mounting interfaces on the top of the bridge member.

14. The accessory mount of claim 13, wherein the actuator arm positions the paddle actuator above the two accessory adapters.

15. The accessory mount of claim 14, further comprising two contact protuberances extending from a bottom face of the paddle actuator.

16. The accessory mount of claim 9, further comprising a cross-bolt safety axially displaceable between an active position, whereby rotational movement of the paddle actuator is prevented, and an inactive position.

17. An accessory mount for a firearm spade grip, the accessory mount comprising:

a bridge member having a top and a bottom, the top of the bridge member includes a mounting interface and the bottom of the bridge member includes a cutout adapted to receive a portion of the firearm spade grip therein;

a clamp member removably attached to the bottom of the bridge member;

an actuator arm having a base and a distal end, the base of the actuator arm is attached to the top of the bridge member;

a paddle actuator rotatably connected to the distal end of the actuator arm;

a control device configured to operate at least one weapon-mounted electrical accessory, the control device is attached to the mounting interface on the top of the bridge member; and a cross-bolt safety axially displaceable between an active position, whereby rotational movement of the paddle actuator is prevented, and an inactive position.

18. The accessory mount of claim 17, wherein the actuator arm positions the paddle actuator above the control device, and the paddle actuator is configured to actuate the control device when pressed down.

19. The accessory mount of claim 18, further comprising a contact protuberance extending from a bottom face of the paddle actuator, the contact protuberance is positioned to actuate the control device when the paddle actuator is pressed down.

* * * * *